United States Patent [19]

Jackson

[11] 4,279,076

[45] Jul. 21, 1981

[54] SCISSORS

[75] Inventor: Dennis B. Jackson, Nunawading, Australia

[73] Assignee: Wiltshire Cutlery Company Proprietary Limited, South Melbourne, Australia

[21] Appl. No.: 95,270

[22] Filed: Nov. 19, 1979

[51] Int. Cl.[3] ..... B26B 13/00; B21K 11/00

[52] U.S. Cl. ..... 30/254; 76/104 A

[58] Field of Search ..... 30/254, 341; 76/104 A, 76/104 R

[56] References Cited

U.S. PATENT DOCUMENTS

| | | | |
|---|---|---|---|
| 616,704 | 12/1898 | Gugel | 30/254 X |
| 3,869,792 | 3/1975 | Laurenti | 30/254 |
| 3,974,564 | 8/1976 | Hough | 76/104 A |
| 4,038,750 | 8/1977 | Moran | 30/254 |

*Primary Examiner*—Jimmy C. Peters

*Attorney, Agent, or Firm*—Ladas & Parry

[57] ABSTRACT

Scissors or other two bladed cutting implements of the kind having a pair of pivotally connected blades, each blade having a cutting edge and a back edge forming respective opposite longitudinal edges of the blade. The improvement comprising forming the cutting edge of each blade so as to lie in the same plane as the back edge of the other blade in the closed condition of the scissors. Both the cutting edge and the back edge are formed at the junction of an inner broad surface of the blade and a respective longitudinal edge surface of the blade, and the back edge surface of one blade is coplanar with the cutting edge surface of the other in the closed condition of the scissors. The plane of those edge surfaces is at an angle other than 90° relative to the plane of the broad inner surface of the blade. The invention also involves a method of forming the improved scissors in which the aforementioned edge surfaces are formed after the scissor blades have been connected and while those blades are in the closed condition.

6 Claims, 5 Drawing Figures

SCISSORS

This invention relates to two bladed cutting implements of the kind having a pair of pivotally connected blades, and those implements will be hereinafter identified generally as scissors although that term as used throughout this specification is to be understood as embracing shears and other implements of the kind indicated.

It is common practice to form scissors in such a way that, in the closed condition, the back edge of each blade projects beyond the cutting edge of the other. That is, the cutting edge is not exposed in the closed condition, and is thereby protected against damage. Furthermore, the cutting edge is prevented from engaging and damaging the surface over which the scissors may be used.

A disadvantage of that conventional form of construction is the difficulty involved in sharpening the blades. In particular, it has been general practice to sharpen each blade individually, and in some cases the blades may need to be physically separated for that purpose.

It is a principal object of the present invention to provide an improved scissor construction which permits the two blades to be sharpened simultaneously while the scissors are in the closed condition.

According to one aspect of the present invention, there is provided scissors including, two blades, pivot means connecting the two blades for relative movement between opened and closed conditions of said scissors, each said blade having a cutting edge and a back edge which respectively form opposite longitudinal edges of said blade, and the cutting edge of each said blade is level with or projects beyond the back edge of the other said blade in the closed condition of said scissors.

According to a further aspect of the invention, there is provided a method of forming scissors of the kind having two pivotally connected blades, including the steps of forming each said blade so as to have two relatively broad opposite surfaces and two relatively narrow opposite surfaces extending in the longitudinal direction of the blade, one said broad surface constituting an inner surface which faces the corresponding surface of the other said blade, forming said narrow surfaces of each said blade so that one is substantially at right angles to said inner surface and constitutes a back surface and the other slopes relative to said inner surface at an angle of less than 90°, said back and sloping surfaces being arranged so that the latter projects beyond the former in the closed condition of said scissors, and subsequently treating said blades in the closed condition of said scissors so that a respective part of each said sloping surface and the adjacent said back surface is removed along substantially the full length thereof to create adjacent and coplanar surface parts on the two said blades, each pair of said surface parts sloping relative to said inner surface at an angle greater than said sloping surface.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 1:
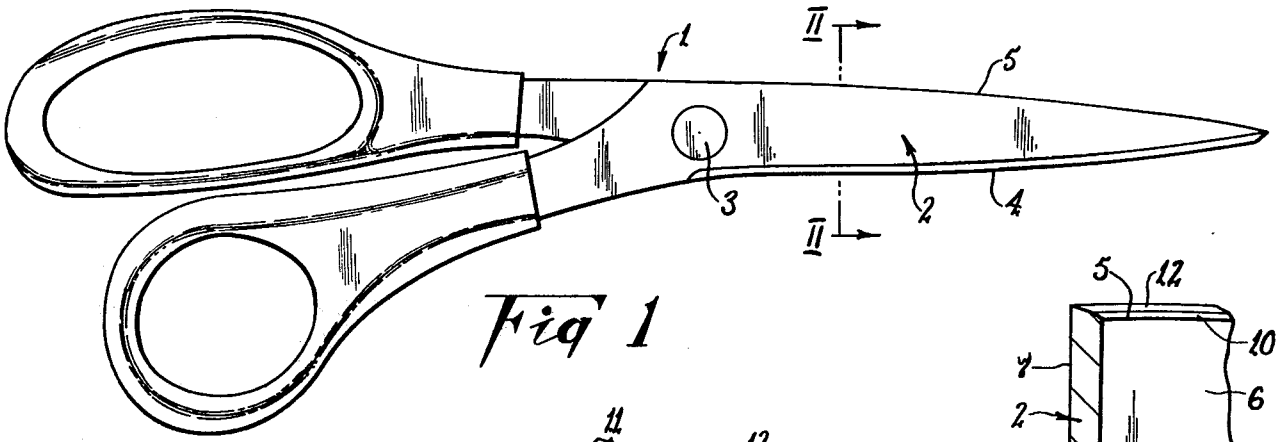
FIG. 1 is a side elevational view of scissors according to one embodiment of the invention.

The two blades 2 of the scissors 1 shown in FIG. 1 are pivotally connected at 3 so that the scissors 1 can be opened and closed. In accordance with the invention, the cutting edge 4 of each blade 2 lies along, or projects beyond, the back edge 5 of the other blade 2, in the closed condition of the scissors 1. Preferably, as shown each cutting edge 4 is disposed at, and follows the path of, the back edge 5 of the other blade 2 when the scissors 1 are closed. That may be achieved in many different forms of construction, but one particular form will be hereinafter described.

Each cutting edge 4 is defined by one longitudinal edge of a broad surface 6 of the blade 2 which faces the corresponding surface of the other blade 2, and will be hereinafter called the inner surface of the blade. The inner surface 6 is generally substantially flat, whereas the opposite broad outer surface 7 may be contoured if desired. For the purposes of the present invention, it is preferred that both the inner and outer surfaces 6 and 7 are substantially flat and substantially parallel, but that is not essential. It may be convenient to form each blade 2 from a plate material.

Figure 2:
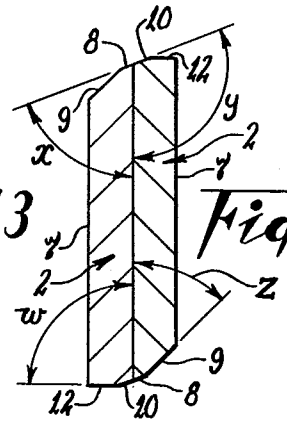
FIG. 2 is an enlarged transverse cross-sectional view taken along line II—II of FIG. 1.

The cutting edge 4 is defined by the common edge or junction of the inner surface 6 and a working surface 8 which is preferably arranged relative to the inner surface 6 such that the angle x subtended between the surfaces 6 and 8 is less than 90° (FIG. 2). It is further preferred, as shown, that the working surface 8 extends partway only across the width of the blade 2, and adjoins a raked surface 9 which is angularly disposed relative to the working surface so that the angle z subtended between it and the inner surface 6 is more acute than the angle x of the working surface 8.

At least an inner part 10 of the surface 11 forming the back edge 5 of each blade 2 is arranged to be a substantial continuation of the working surface 8 of the other blade 2 in the closed condition of the scissors 1 (FIG. 2). That is, the surface part 10 follows the same longitudinal path as the working surface 8, and slopes at the same angle to the inner surface 6 of the other blade 2. It will be understood that as a result of that relationship, each surface part 10 subtends an angle y of more than 90° to the inner surface 6 of the blade 2 with which it is associated. Also the surface part 10 is adjacent its associated inner surface 6 and may continue across the full width of the blade 2 if desired. In the construction shown however, an outer part 12 of the back surface 11 is angularly disposed relative to the inner part 10, and the angle w subtended between the surface part 12 and the inner surface 6 is less than the angle y. It is preferred that surface part 12 is substantially at right angles to the inner surface 6 of the blade 2 so as to minimize damage to any object over which the scissors 1 might be used.

It will be appreciated from the foregoing that the sloping inner part 10 of the back surface 11 of each blade 2 takes the back surface 11 beyond the cutting edge 4 of the other blade 2, and thereby protects that cutting edge 4 from damage (see FIG. 2). Furthermore, sharpening of the blades 2 is facilitated by the fact that the adjacent surface parts 8 and 10 of the two blades slope at substantially the same angle, and therefore form a substantial continuation of one another. That is, a sharpening element having the same angular relationship to the inner surfaces 6 of the blades 2 can remove metal from or hone both surface parts 8 and 10 in a single operation and thereby sharpen the cutting edge 4. A sharpening device suitable for that purpose is described in a copending patent application by the same applicant.

Figure 5:
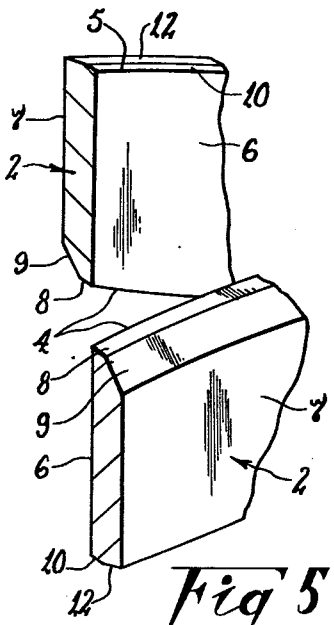
FIG. 5 is a view similar to FIG. 4 but showing the blades opened to a further extent.
Figure 4:
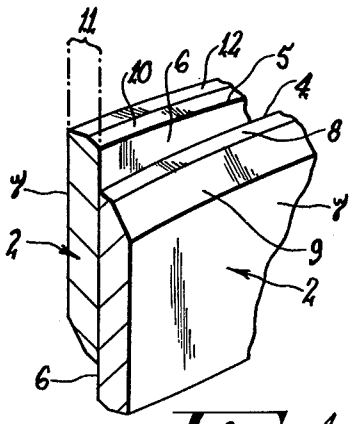
FIG. 4 is a perspective view of portion of the blades shown in a partially opened condition.
Figure 3:
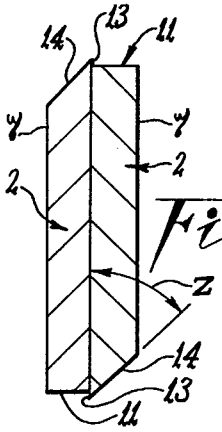
FIG. 3 is a view similar to FIG. 2 but showing the relationship between the two blades before finishing of those blades.

Scissors of the kind described can be produced in any appropriate manner. According to one preferred method however, the blades 2 are initially formed in the fashion shown in FIG. 3 so that an edge 13 of each blade 2 projects beyond the back surface 11 of the other blade 2. That projection may be relatively small such as 0.005" for example, and the edge 13 is formed by the junction of the inner surface 6 and a sloping surface 14. The projection ensures that a cutting edge 4 can be produced with minimum removal of material. That is, the surfaces 8 and 10 need not be substantial so that subsequent sharpening is not made difficult. FIGS. 2, 4 and 5 show the surfaces 8 and 10 as being perhaps larger than necessary, at least in the initial form of the scissors, and those surfaces are formed by grinding or any other suitable finishing operation. The outer part of the surface 14 may subsequently become the raked surface 9 as previously described.

Finally, it is to be understood that various alterations, modifications and/or additions may be introduced into the constructions and arrangements of parts previously described without departing from the spirit or ambit of the invention as defined by the appended claims.

Having now described my invention, what I claim as new and desire to secure by Letters Patent is:

1. Scissors including, two blades, pivot means connecting the two blades for relative movement between opened and closed conditions of said scissors, each said blade having:

inner and outer substantially parallel broad surfaces, the inner broad surfaces of said blades being in opposed relationship, a working surface;

a raked surface being interposed between each said working surface and the said outer surface of the respective said blade, the included angle between said raked surface and the said inner surface being less than the included angle between the inner surface and the said working surface, and a cutting edge and a back edge which respectively form opposite longitudinal edges of said blade, the cutted edge of each said blade being defined at the junction of the respective said inner and working surfaces of said blade and the width of the inner surface of each blade being such that the cutting edge of the blade is at least level with the back edge of the other said blade in the closed condition of said scissors and each said cutting edge being disposed at and following the path of the back edge of the other blade in said closed condition.

2. Scissors according to claim 1, wherein the included angle between said inner and working surfaces is less than 90°.

3. Scissors according to claim 2, wherein each said back edge is defined at the junction of a respective said inner surface and a back surface of the blade, at least an inner part of said back surface which is adjacent said inner surface being at an angle such as to be in the same plane as the working surface of the other said blade in the closed condition of said scissors.

4. Scissors according to claim 3, wherein each said back surface has an outer part adjacent said outer surface of the blade, and the included angle between said outer part and the inner surface of the respective said blade is less than the included angle between that inner surface and the inner part of the respective said back surface.

5. Scissors according to claim 4, wherein the included angle between said outer part and the respective said inner surface is substantially 90°.

6. A method of forming scissors of the kind having two pivotally connected blades, including the steps of forming each said blade so as to have two substantially parallel relatively broad opposite surfaces and two relatively narrow opposite surfaces extending in the longitudinal direction of the blade, one said broad surface constituting an inner surface which faces the corresponding surface of the other said blade, forming said narrow surfaces of each said blade so that one is substantially at right angles to said inner surface and constitutes a back surface and the other slopes relative to said inner surface at an angle of less than 90°, said back and sloping surfaces being arranged so that the latter projects beyond the former in the closed condition of said scissors, and subsequently treating said blades in the closed condition of said scissors so that a respective part of each said sloping surface and the adjacent said back surface is removed along substantially the full length thereof to create adjacent and coplanar surface parts on the two said blades, each pair of said surface parts sloping relative to said inner surface at an angle greater than said sloping surface.

* * * * *